United States Patent [19]

Bourdo

[11] 3,942,779

[45] Mar. 9, 1976

[54] CLAMPING ASSEMBLY

[75] Inventor: John Lorin Bourdo, Phoenix, Ariz.

[73] Assignee: Automated Construction Industries, Inc., Phoenix, Ariz.

[22] Filed: Nov. 20, 1974

[21] Appl. No.: 525,294

Related U.S. Application Data

[63] Continuation of Ser. No. 337,155, March 7, 1973, abandoned.

[52] U.S. Cl. ..... 269/41; 269/102; 269/285; 269/321 S

[51] Int. Cl.[2] ..... E04G 21/16

[58] Field of Search ..... 269/41, 45, 152, 155, 156, 269/102, 321 S, 321 F, 285; 228/44

[56] References Cited

UNITED STATES PATENTS

| | | | |
|---|---|---|---|
| 953,923 | 4/1910 | Rowe | 29/250 |
| 1,422,272 | 7/1922 | Jaskowiak | 269/152 X |
| 2,230,918 | 2/1941 | Walter | 29/256 |
| 2,270,766 | 1/1942 | Pierce | 269/155 |
| 2,606,583 | 8/1952 | O'Connor | 269/41 X |

FOREIGN PATENTS OR APPLICATIONS

| | | | |
|---|---|---|---|
| 602,344 | 9/1934 | Germany | 269/41 |

*Primary Examiner*—Roy Lake
*Assistant Examiner*—Neil Abrams
*Attorney, Agent, or Firm*—Ronald J. Clark

[57] ABSTRACT

A clamping assembly is disclosed to hold walls and the like in position during construction of housing. The assembly is located and supported by a base which is held in place by nails driven into the floor. An upright beam held by the base is keyed at a location above the walls being held together to a rod connected to a vise unit. The vise is manually closed around one of the walls being joined. Movable jaws spaced along the upright beam are manually moved into contact with the other wall. The assembly is economic, effecient, and adapted for reuse.

6 Claims, 4 Drawing Figures

CLAMPING ASSEMBLY

This is a continuation of application Ser. No. 337,155, filed Mar. 7, 1973, now abandoned.

BACKGROUND OF THE INVENTION

This invention relates to devices to hold large structures during assembly, and, more specifically, elements to hold sheet components such as walls while they are positioned for a joining operation as by the use of an adhesive.

Various clamping arrangements and assemblies are known in the prior art. In particular, clamping of two elements together by movable jaws each spaced 90°from one another is employed in various forms. But no such device is known having a base removably anchored in a floor or which is otherwise specifically suited to hold wall members.

In fact, mush of the present state of the art of housing construction still relies on crude or inefficient methods and on tools not specifically designed for the job conducted. One effecient method of construction is to construct completed wall members and the like and to them combine them into housing. The clamping assembly of the instant invention is a valuable tool well suited for such an application, especially where the wall members are to be joined by an adhesive. With the use of this relatively uncomplicated tool, the wall members are biased firmly together in an efficient manner. The tool is readily reusable.

SUMMARY OF THE INVENTION

It is an object of this invention to provide a clamping assembly which produces firm clamping of large, flat members, such as walls.

It is a related object of this invention to provide such a clamping assembly which is suited for efficient and repeated use in the construction of structures such as housing.

It is another object of this invention to provide a clamping assembly which may be anchored to a floor member.

It is similarly an object of this invention to provide such a clamping assembly which is uncomplicated, and thereby relatively trouble free in operation and economical.

It is another, object of this invention to provide a clamping assembly which may be adapted readily to hold members of different sizes.

It is a more specific object of this invention to provide a clamping assembly having a reinforcing backing member.

It is another object of this invention to provide a clamping assembly which may be adapted for use in a specific application and subsequently reused for the same or generally alike applications.

In accordance with this invention, an elongated, upright beam is held and positioned by a base plate. Spikes holding the base plate are driven into the floor. Jaws movable perpendicular to the long axis of the beam are positioned at spaced locations along the beam. At the upper end of the beam a vise adapted to close around the other wall is linked to the beam.

BRIEF DESCRIPTION OF THE DRAWINGS

These and other objects, features, characteristics, and advantages of the invention will be apparent by consideration of the following description of a preferred embodiment, as illustrated by the accompanying drawings.

DESCRIPTION OF THE PREFERRED EMBODIMENT

Figure 1:
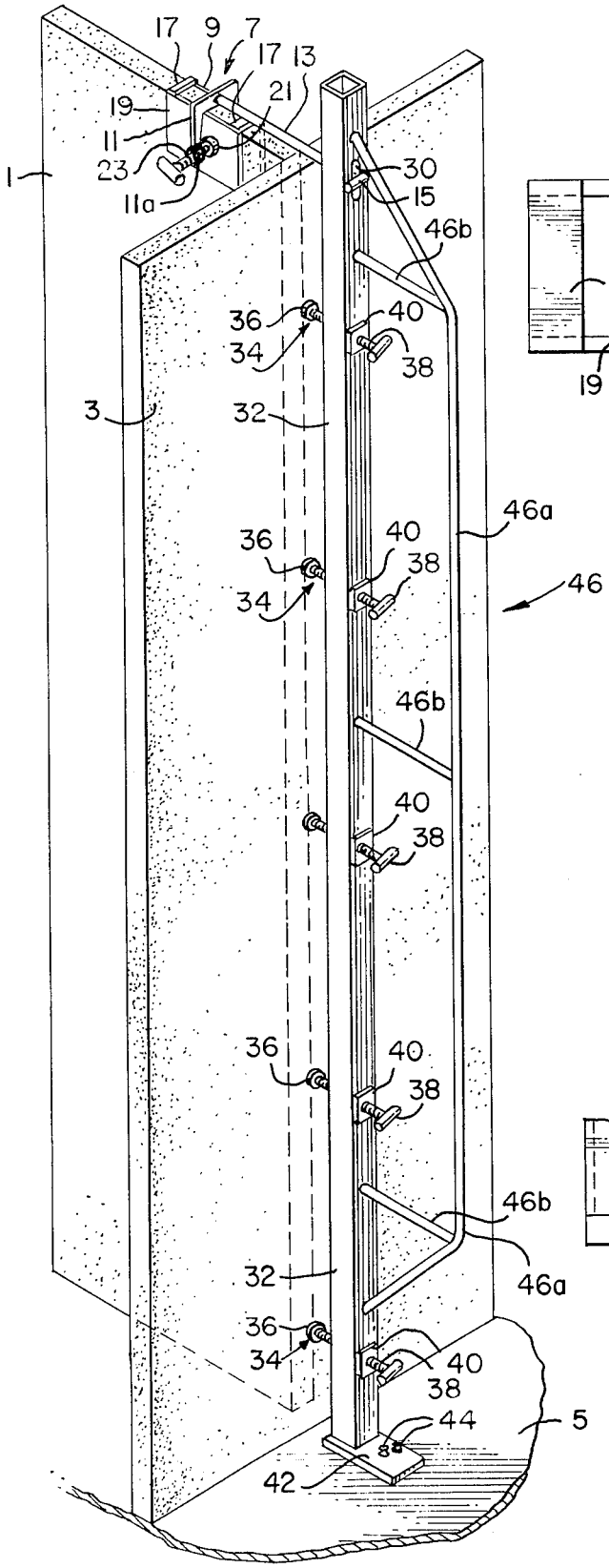
FIG. 1 is a perspective view of the clamp assembly in final position holding two wall members together.

FIG. 1 illustrates a perspective view of the clamping assembly in a typical application in which it is used to position two wall members 1 and 3, resting on a floor 5, in a "T" configuration. With minor and straightforward variations, the system can be used to similarly hold such members in other configurations, including straight joints and corner joints.

Figure 2:
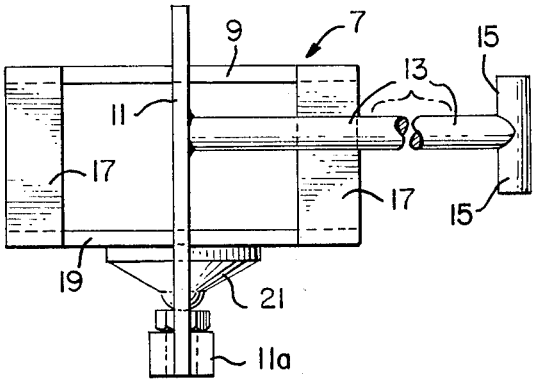
FIG. 2 is a top view of the vise unit.

The clamping assembly comprises a vise unit 7 (see also FIG. 2, which is a top view), which comprises a unitary contact member 9, yoke 11, and connecting rod 13, which is fastened to the center of yoke 11 and has perpendicular, handle-like extensions 15 at the end away from yoke 11. Supports 17 are each welded to the top of contact member 9 at each end and extend across to the opposite contact member 19, but are not fastened to contact member 19. Contact members 9 and 19 both have relatively large areas facing each other and adapted to close around a wall member or the like from each side and hold the member without damage to it.

A ball joint terminal 21 is fastened to member 19 on the side away from member 9. In the preferred embodiment the terminal 21 is held in place by flat-head screws which extend through member 19 into terminal 21 and are sunk so as to not present raised portions on the face of member 19 which might damage a wall member. A threaded rod 23, having perpendicular extensions at one end as handles, fits through and meshes with threads at the end part 11*a* of yoke 11, and extends further to fit into terminal 21 to form a ball joint with terminal 21. The end part 11A is a threaded cylinder which is welded to the main, plate body of the yoke 11.

Perferably, all parts of the vise unit 7 are aluminum for the relatively low weight obtained, and the joints are accomplished by welding.

Rod 13 of vise unit 7 extends through slots 30 in opposite sides of upright beam 32. When vise 7 is positioned so that members 9 and 19 grip a wall member in normal use of the clamp assembly, the rod 13 is turned so that the perpendicular extensions 15 are blocked by the sides of the adjoining slot 30. In assemblying the clamp, rod 13 is positioned to 90°of that posture, and in that position the ends 15 are passed through the slots 30.

When in place upright beam 32 is somewhat taller than the walls 1 and 3 so that rod 13 is positioned over the walls 1 and 3. At locations spaced along the length of beam 32, manually adjustable jaws 34 extend through the beam 32. In the preferred embodiment there are five such jaws 34, evenly spaced along beam 32, with the bottom jaw being relatively close to the floor.

Figure 3:
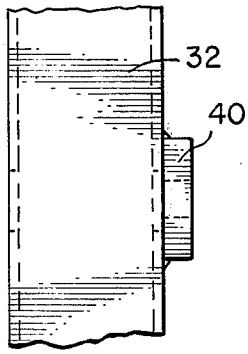
FIG. 3 is a side view of the upright beam at a location where it is reinforced to hold a rod which is part of a movable jaw.

Each jaw 34 has a foot 36, which is adapted to engage the wall firmly without damage to it. The foot 36 is mounted in a ball joint on the end of a threaded rod 38, and rod 38 is terminated by perpendicular extensions forming a handle. The beam 32 is reinforced at the location of each rod 38 by a plate 40 (also FIG. 3, a side view), approximately ⅓ inch thick, welded to the side of beam 32 away from the walls 1 and 3, and having threads which mesh with the threads of rod 38.

Figure 4:
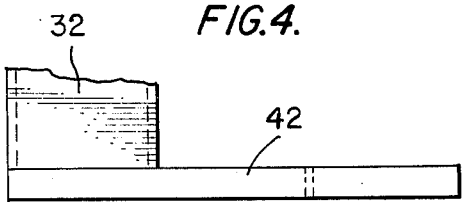
FIG. 4 is a side view of the plate which anchors the assembly to the floor.

The low end of upright beam 32 engages and is held by a floor plate 42. The connection may be by insertion into a meshing hole or other suitable temporary connection, although in the preferred embodiment the connection is a permanent one by welding, as shown best by the side view of FIG. 4. Plate 42 is held by nails or spikes 44, which are driven into the floor to thereby firmly position the plate 42 and thus position the entire clamp assembly. In the preferred embodiment the nails 44 are initially completely separate and are brought to the plate 42 and driven through the holes in plate 42 into the floor.

Lastly, along the length of beam 32 is a reinforcing backing 46, made of a ½ inch diameter aluminum tubing, welded where it is fastened to the beam 32. The long, outer tube **46*a*, which is parallel to the beam 32, has three perpendicular connecting tubes 46*b*, which are welded to both the outer tube 46*a* and to the beam 32. The outer tube 46*a* is bent at approximately a 45°angle at each end so that it extends down to the beam 32 and forms a triangle with a perpendicular tube 46*b*** which extends to the point at which the bend originates.

All of the parts of the beam 32, the reinforcing back 46, and the other parts connected to them are preferably aluminum, employed for the low weight of the material, except the spikes 44 for which iron or steel is used for the hard penetrating characteristics provided. In the preferred embodiment shown, major dimensions, by way of example only, are: contact members 9 and 19, 6 × 3.75 inch plate; upright beam 32, 2 × 2 inch tubing; and floor plate 42, 6 × 3 inch plate.

In Use

The assembly is handled manually during typical use. Typically, one of the wall members, for example member 1, will have been previously fastened to the floor, as by epoxy cement. The other wall member and the clamp are handled by the number of individuals reasonably necessary in view of the weight and bulk of those members.

The vise unit 7 is turned bodily to a posture at which the extensions 15 of rod 13 pass through the slots 30 in beam 32. Vise 7 is then positioned with contact members 9 and 19 on opposite sides of wall 1. The vise unit 7 may be allowed to rest on supports 17 while the rod 23 is turned manually. Rotation of rod 23 brings member 19 toward wall 1, where it flattens against wall 1 by turning on the ball joint formed with terminal 21. This is continued until wall 1 is held under firm pressure between members 9 and 19.

Plate 42 is moved to a position approximately under the location at which beam 32 would be parallel to walls 1 and 3, and the nails 44 are then driven through the holes in plate 42 and into the floor. Prior to tightening jaws 34, wall 3 is moved into place, such as to form a "T" configuration as shown, or other configuration. The primary application contemplated is to cement the members together, as by epoxy adhesive, and the cement is also applied prior to the tightening of jaws 34.

The jaws 34 are tightened manually by turning the threaded rods 38, using the handles 40 of each rod. Each foot 36 of the jaw 34 automatically turns on its ball joint to conform to the wall 3. When extensions 15 abut firmly against the sides of slot 30, further outward movement of beam 32 is prevented.

The two walls are then held firmly in place, and nothing further need be done until the curing of the adhesive or any other operation is completed. Then the tightening members 23 and 38 are simply loosened, and the nails 44 are pried from the floor.

The assembly readily fits wall members and the like of different sizes. In addition to being usable for various joint configurations, it will be clear that the clamp assembly itself may be used in various configurations. Thus, three of the assemblies could be used in a mode similar to that described, in which the top parts of the three clamp assemblies are connected together by rods. Refinements of the invention and other variations will be apparent, and variations may well be developed which employ more than ordinary skill in this art, but nevertheless employ the basic contribution and elements of this invention. Accordingly, patent protection should not be essentially limited by the preferred embodiments disclosed, but should be as provided by law, with particular reference to the accompanying claims.

What is claimed is:

1. A member for clamping one wall section to a second wall section in the manufacture of a structure, said clamping member comprising:

a base adapted to be removably attached to a supporting surface;

an elongated upright support member having an upper end and a lower end and said lower end of said support member being held by said base for positioning said support member generally perpendicular to said supporting surface; said support member having attached thereto at least one jaw movable toward and away from said support member in directions generally perpendicular to the long axis of said support member;

a clamping assembly including vise means coupled to a connecting means and said connecting means also being in movable engagement with said support member at a point located generally at said upper end; and said connecting means having a rod like member attached to said vise means and having means laterally extending from said rod to contact said support member, and said support member having an opening adapted to permit said rod like member to prevent said laterally extending means from freely passing through said opening; whereby, when a first wall is to be joined to a first surface of a second wall said upright support member is positioned alongside a second surface of the second wall, said vise means grips said first wall, said connecting means extends over said second wall for engaging said upright support means, and said movable jaw is moved against said second surface of said second wall for urging said first and second structural walls into engagement.

2. The member as in claim 1 in which said base is adapted to be removably attached to a floor by spikes driven into the floor.

3. The member as in claim 1 in which said elongated support member has an elongated reinforcing member fastened to said support member on the side away from said movable jaw.

4. The member as in claim 1 in which said at least one movable jaw comprises at least two movable jaws located at spaced locations on said elongated dimension of said support member.

5. The member as in claim 4 in which said elongated support member has an elongated reinforcing member fastened to said support member on the side away from said movable jaws.

6. The member as in claim 5 in which said reinforcing member is an elongated tube generally parallel to said support member, connected to said support member by extensions from said tube welded to said support member.

* * * * *